United States Patent [19]

Eitai et al.

[11] Patent Number: 4,929,156

[45] Date of Patent: May 29, 1990

[54] VARIABLE CAPACITY COMPRESSOR

[75] Inventors: Kazuo Eitai; Hidehiko Takayama, both of Konan, Japan

[73] Assignee: Diesel Kiki Co., Ltd., Tokyo, Japan

[21] Appl. No.: 303,931

[22] Filed: Jan. 30, 1989

[30] Foreign Application Priority Data

Mar. 15, 1988 [JP] Japan ..... 63-61663

[51] Int. Cl.[5] ..... F04C 29/08; F04B 49/02

[52] U.S. Cl. ..... 417/295; 417/310

[58] Field of Search ..... 417/295, 310

[56] References Cited

U.S. PATENT DOCUMENTS

| | | | |
|---|---|---|---|
| 4,726,740 | 2/1988 | Suzuki et al. | 417/310 |
| 4,737,081 | 4/1988 | Nakajima et al. | 417/310 |
| 4,801,251 | 1/1989 | Nakajima et al. | 417/310 |

*Primary Examiner*—Leonard E. Smith

*Attorney, Agent, or Firm*—Charles S. McGuire

[57] ABSTRACT

A variable capacity compressor has first and second discharge pressure chambers provided, respectively, on opposite sides of a cylinder. A first communication passage communicates the first and second discharge pressure chambers with each other. A discharge port directly communicates with the first discharge pressure chamber. A capacity control device is operable in response to control pressure for controlling the capacity of the compressor and has a control pressure chamber in which the control pressure prevails. A second communication passage communicates the second discharge pressure chamber with the control pressure chamber. The second discharge pressure chamber is formed of an oil sump section communicating with the first discharge pressure chamber through the first communication passage, and a high pressure-introducing section supplied with compression medium delivered from the cylinder, wherein partition walls are provided which isolate the high pressure-introducing section from the oil sump section.

5 Claims, 7 Drawing Sheets

VARIABLE CAPACITY COMPRESSOR

BACKGROUND OF THE INVENTION

This invention relates to a variable capacity compressor for compressing refrigerant for use in air conditioning systems such as those for automotive vehicles, and more particularly to a compressor of this kind which has improved lubrication of its component parts.

Conventionally, a variable capacity compressor is known which is provided with capacity control means which is operable in response to discharge pressure thereof as control pressure. The known compressor has a first discharge pressure chamber disposed on one side of a pump body, in communication with a discharge port adapted to be connected to a refrigerating circuit, a second discharge pressure chamber disposed on another side of the pump body to be supplied with discharge pressure (control pressure), and a communication passage communicating the first and second discharge pressure chambers with each other. However, with such arrangement, pressure within the first pressure chamber and pressure within the second pressure chamber are different from each other so that there occurs a difference in oil surface level between oil sumps formed at lower portions of the respective discharge pressure chambers. Consequently, lubricating parts on the side of the oil sump having the lower oil surface level is lubricated to an insufficient extent.

More specifically, referring to FIGS. 1 and 2 showing the known variable capacity vane compressor, a cylinder is formed by a cam ring 1, and a front side block 2 and a rear side block 3 closing respective opposite ends of the cam ring 1. A front head 4 and a rear head 5 are secured to outer ends of the respective front and rear side blocks 2 and 3. A front discharge pressure chamber 6 and a rear discharge pressure chamber 7 are defined, respectively, between the front side block 2 and the front head 4, and between the rear side block 3 and the rear head 5. The discharge pressure chambers 6 and 7 communicate with each other via a communication passage 8, the front chamber 6 directly communicating with a discharge port 9 through which compression medium or refrigerant is discharged. A capacity control device 10 is provided in the rear side block 3 and operable in response to pressure within a suction chamber, not shown, as well as pressure within the rear discharge pressure chamber 7 to control the capacity of the compressor. The capacity control device 10 has a control pressure chamber 11, to which high discharge pressure within a discharge valve chamber 12 is supplied through first and second communication passages 13 and 14, the rear discharge pressure chamber 7, a third communication passage 15, in the mentioned order, for controlling the capacity of the compressor in cooperation with pressure within the suction chamber.

According to the known compressor, the rear discharge pressure chamber 7 is formed of a high pressure-introducing chamber section **7*a* located at an upper portion thereof, into which high discharge pressure is introduced from the discharge valve chamber 12, and an oil sump section 7*b* located at a lower portion thereof, the two sections 7*a* and 7*b* communicating with each other through a communication passage 7*c* defined in the rear head 5. With this arrangement, provided that the pressure within the discharge valve chamber 12 is designated by $P_{d1}$, the pressure within the front discharge pressure chamber 6 $P_{d2}$, and the pressure within the rear discharge pressure chamber 7** $P_{d3}$, respectively, the relationship of $P_{d1}>P_{d2}>P_{d3}$ holds, because the pressure $P_{d2}$ acts as dynamic pressure, whereas the pressure $P_{d3}$ acts as static pressure.

Consequently, the level $L_1$ of the surface of oil stored in the rear oil sump section **7*b* is lowered to a level close to the communication passage 8 due to the pressure difference, while the level $L_2$ of the surface of oil in the bottom of the front discharge pressure chamber 6 rises. As a result, an insufficient amount of oil can be supplied to lubricating parts on the rear side such as a rear bearing 17 supporting a drive shaft 16**, resulting in poor lubrication of the rear side lubricating parts.

SUMMARY OF THE INVENTION

It is the object of the invention to provide a variable capacity compressor which has improved lubrication of lubricating parts on both the front and rear sides of the compressor.

It is a further object of the invention to provide a variable capacity compressor which is capable of supplying the capacity control device with control pressure which is free from pulsation in the discharge pressure.

To attain the above objects, the present invention provides a variable capacity compressor having a cylinder, first and second discharge pressure chambers provided, respectively, on opposite sides of the cylinder, first communication passage means communicating the first and second discharge pressure chambers with each other, a discharge port directly communicating with the first discharge pressure chamber, capacity control means operable in response to control pressure for controlling the capacity of the compressor, the capacity control means having a control pressure chamber in which the control pressure prevails, and second communication passage means communicating the second discharge pressure chamber with the control pressure chamber.

The variable capacity compressor according to the invention is characterized by the improvement wherein the second discharge pressure chamber is formed of an oil sump section communicating with the first discharge pressure chamber through the first communication passage, and a high pressure-introducing section disposed to be supplied with compression medium delivered from the cylinder, and means is provided which isolates the high pressure-introducing means from the oil sump section.

Preferably, the high pressure-introducing section of the second discharge pressure chamber may be in the form of a substantially enclosed chamber.

More preferably, the variable capacity compressor may include discharge valve means, a discharge valve chamber accommodating the discharge valve means, and third communication passage means communicating the discharge valve chamber with the high pressure-introducing section of the second discharge pressure chamber, and wherein the high pressure-introducing section has a substantially larger cross-sectional area than that of the third communication passage means.

Further preferably, the means isolating the high pressure-introducing section from the oil sump section of the second pressure chamber may comprise partition wall means formed in the second head.

The above and other objects, features and advantages of the invention will become more apparent from the ensuing detailed description taken in conjunction with the accompanying drawings.

DETAILED DESCRIPTION

The invention will now be described in detail with reference to FIG. 3 through FIG. 7 of the drawings, showing an embodiment thereof.

Figure 1:
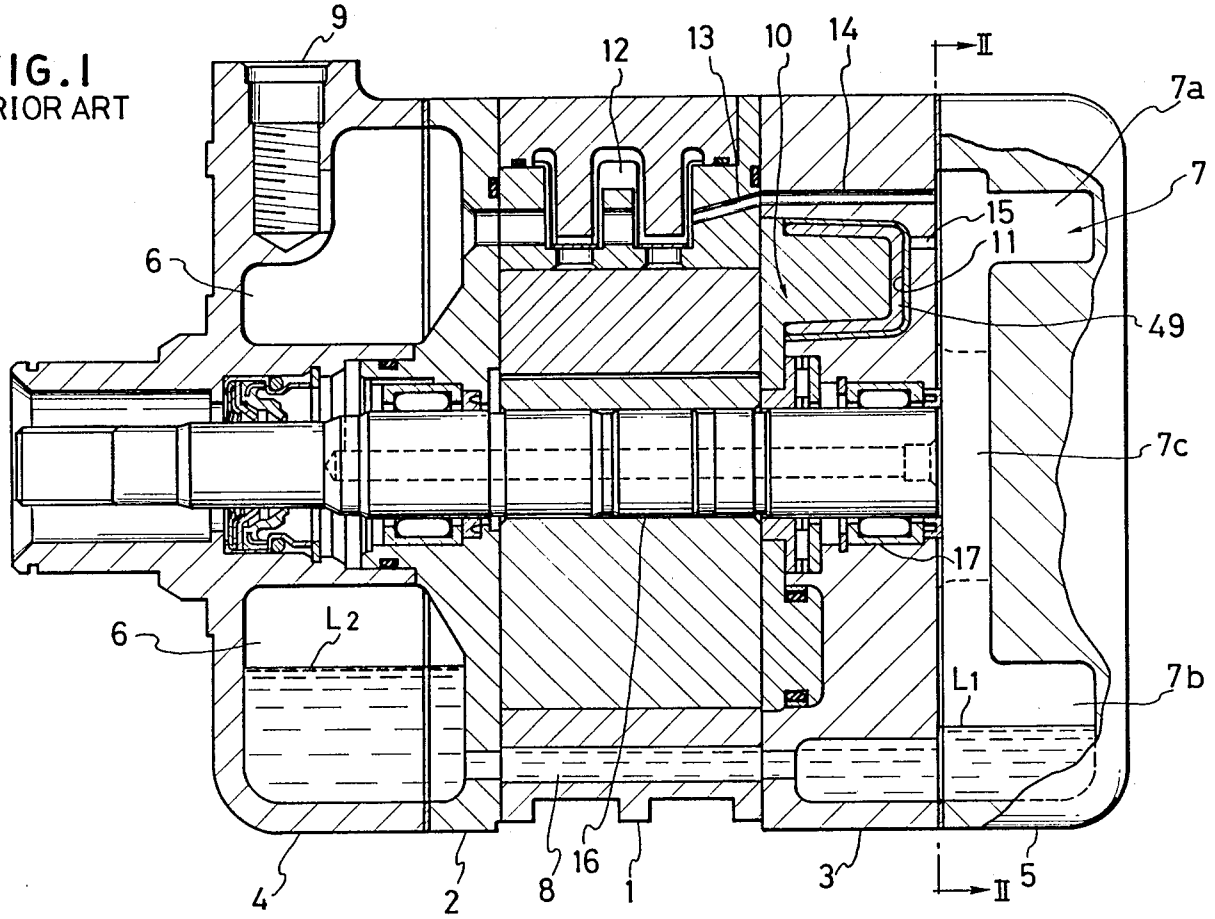
FIG. 1 PRIOR ART
FIG. 1 is a longitudinal sectional view of a conventional variable capacity compressor.
Figure 2:
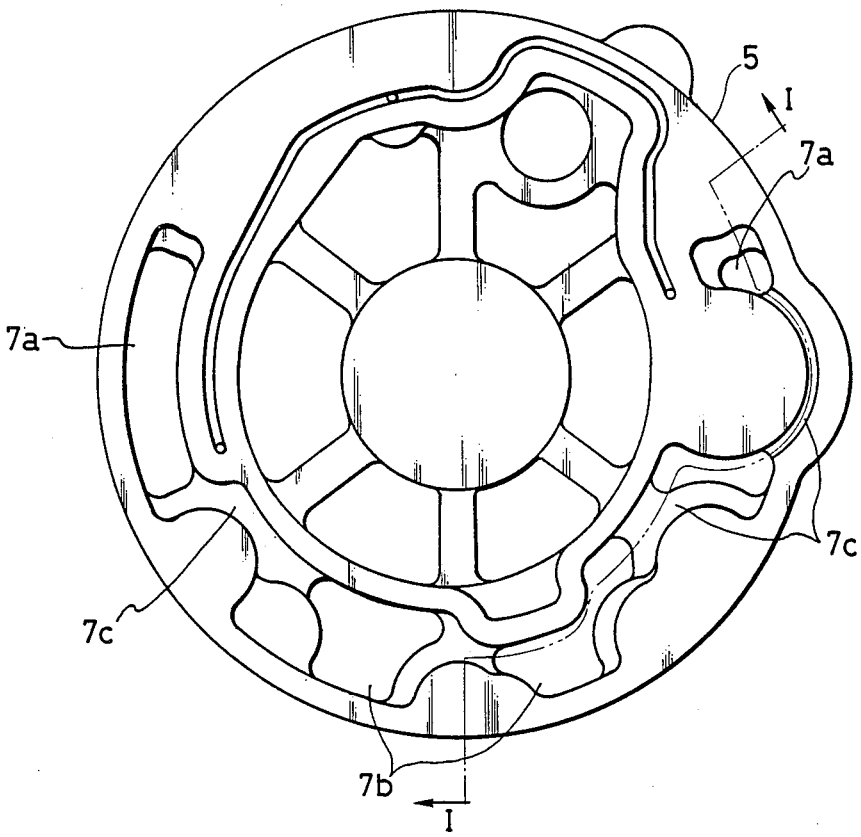
FIG. 2 PRIOR ART
FIG. 2 is a transverse sectional view taken along line II—II in FIG. 1.
Figure 3:
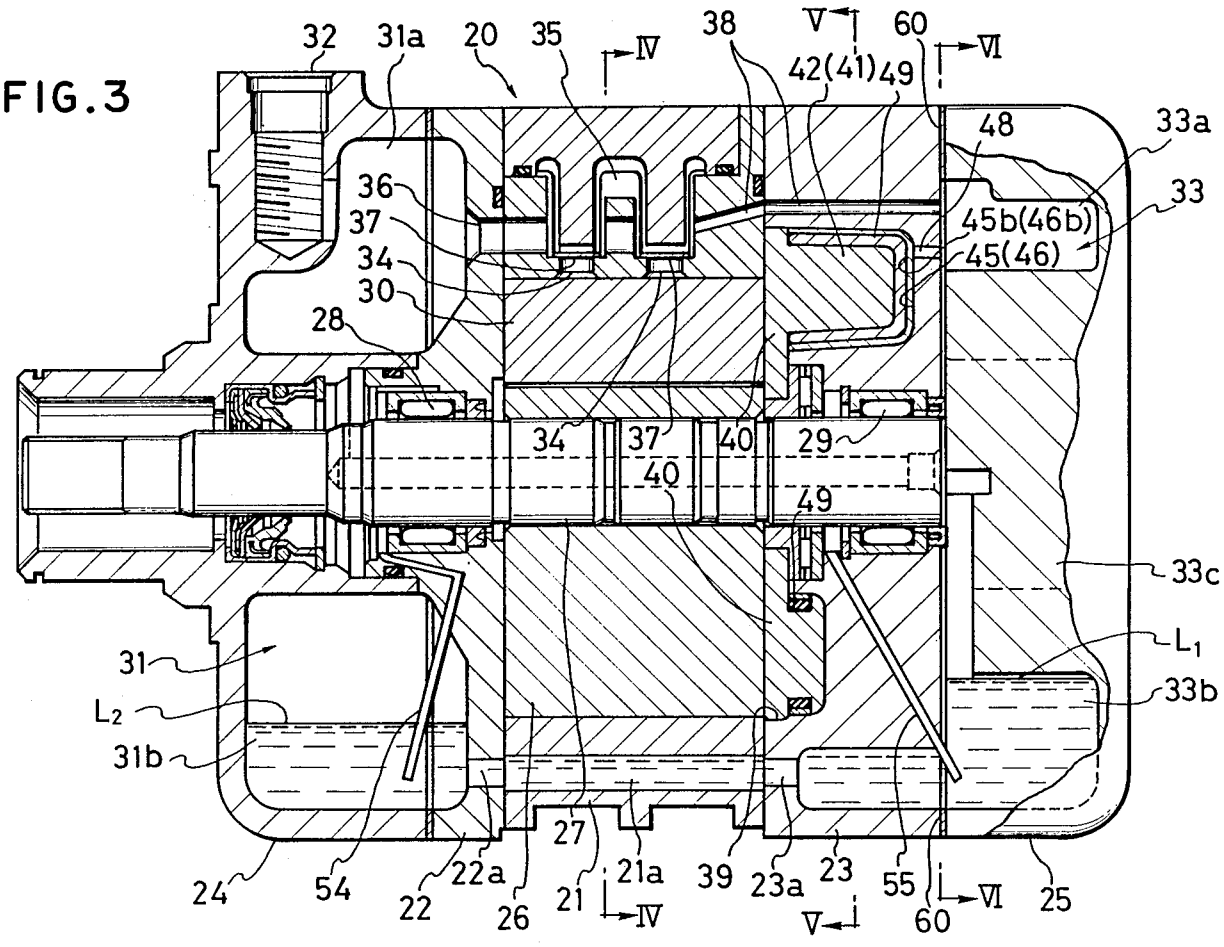
FIG. 3 is a longitudinal sectional view of a variable capacity compressor according to an embodiment of the invention.

Referring first to FIG. 3, there is illustrated a variable capacity compressor according to the invention. In the figure, reference numeral 20 designates a pump body, which is mainly composed of a cylinder formed by a cam ring 21 having a camming inner peripheral surface with a generally elliptical cross section, as shown in FIG. 2, and a front side block 22 and a rear side block 23 closing respective opposite ends of the cam ring 21 in an airtight manner, and a front head 24 and a rear head 25 secured to outer ends of the respective front and rear side blocks 22, 23 in an airtight manner.

Rotatably received within the cylinder is a cylindrical rotor 26 which is secured on a driving shaft 27 at an intermediate portion thereof. The driving shaft 27 is rotatably supported by a pair of bearings 28, 29 provided in the respective side blocks 22, 23, and has its front end connected to an internal combustion engine, not shown, installed on a vehicle, to be rotatively driven thereby.

Figure 4:
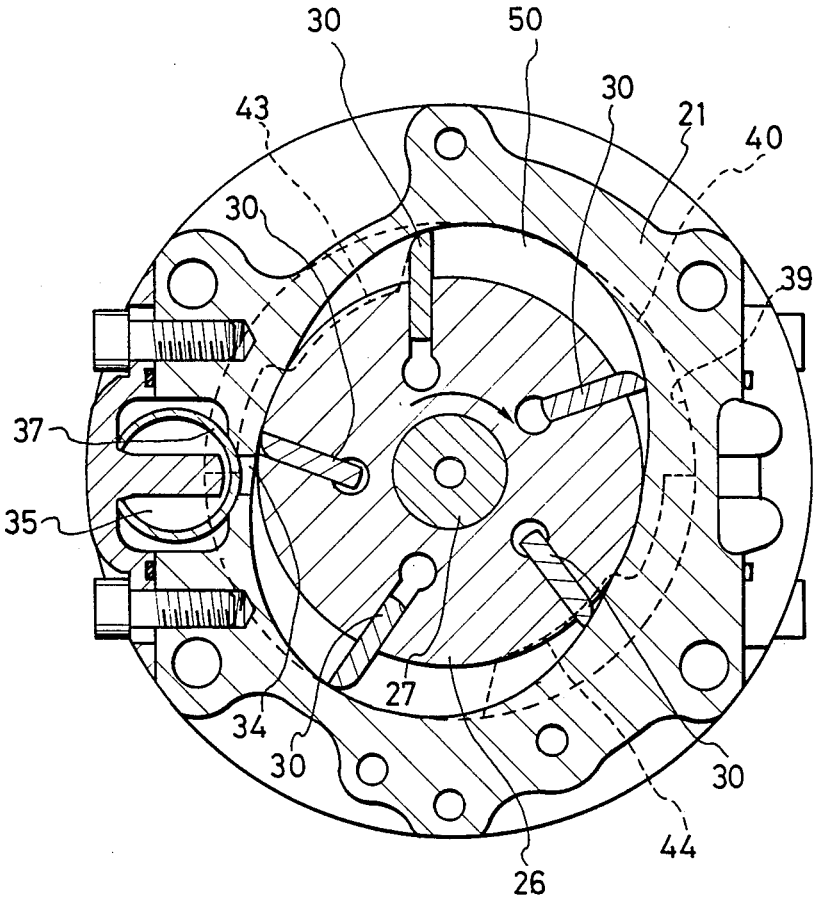
FIG. 4 is a transverse sectional view taken along line IV—IV in FIG. 3.

The rotor 26 has its outer peripheral surface formed therein with a plurality of axial vane slits at circumferentially equal intervals, in each of which a vane 30 is radially slidably fitted, as shown in FIG. 4.

A front discharge pressure chamber 31 is defined in the form of an annulus between the side block 22 and the front head 24. The front discharge pressure chamber 31 is formed of a discharge pressure chamber section **31*a* located at an upper portion thereof, and an oil sump section 31*b* located at a lower portion thereof. The discharge chamber section 31*a* directly communicates with a discharge port 32 formed in an upper wall of the front 24** and adapted to be connected to a refrigerating circuit, not shown.

Figure 6:
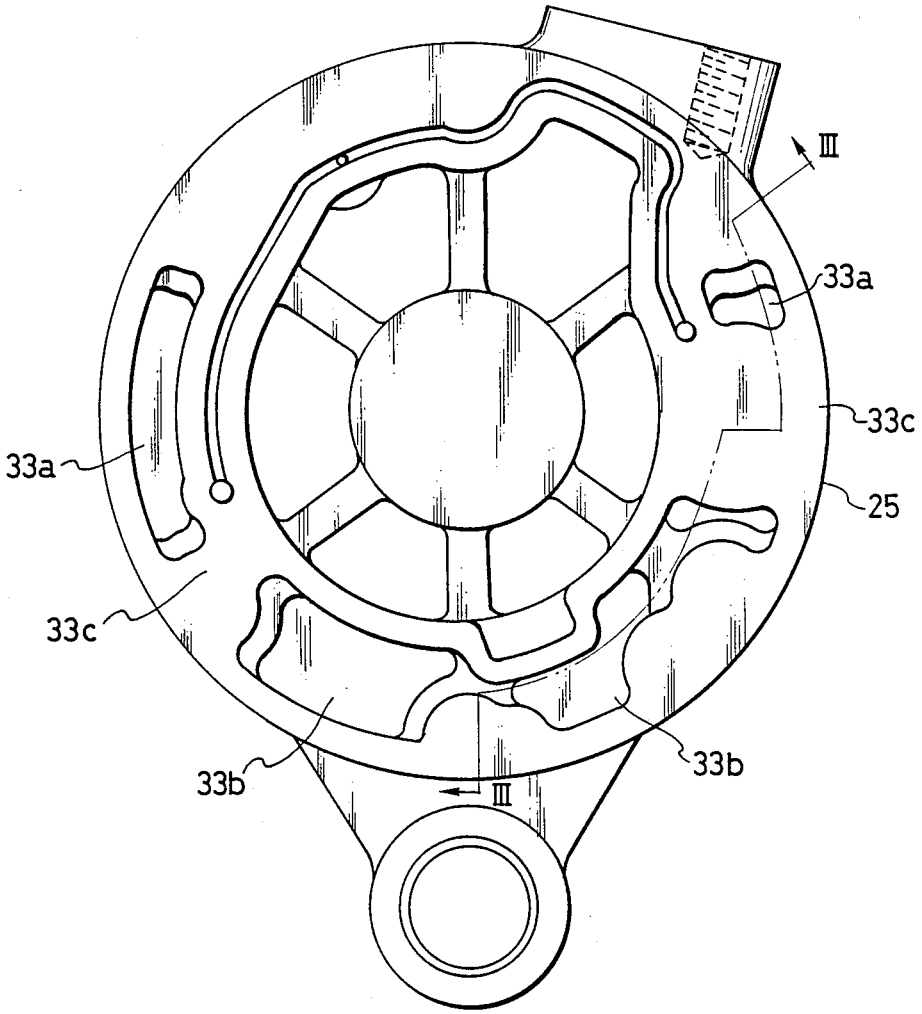
FIG. 6 is a transverse sectional view taken along line VI—VI in FIG. 3.

On the other hand, a rear discharge pressure chamber 33 is defined between the rear block 23 and the rear head 25. Like the front discharge pressure chamber 31, the rear discharge pressure chamber 33 is formed of a pair of high pressure-introducing chamber sections **33*a* each located at an upper portion thereof, and an oil sump section 33*b* located at a lower portion thereof The sections 33*a* are separated or isolated from the 33*b* by partition walls 33*c* formed integrally with the rear head 25**, as shown in FIG. 6.

A generally annular gasket sheet 60 is interposed between the rear side block 23 and the rear head 25 in a manner covering solid portions of an end surface of the rear head 25 facing the rear side 23, the solid portions including the partition walls **33*c* and being all flush with each other, so that the high pressure-introducing chamber sections 33*a* are separated in an airtight manner from the oil sump section 33*b***.

The front oil sump section **31*b* the rear oil sump section 33*b* communicate with each other by way of communication passages 22*a*, 21*a*, and 23*a* formed, respectively, through the front side block 22, cam ring 21, and rear side block 23** at their lower portions.

Figure 7:
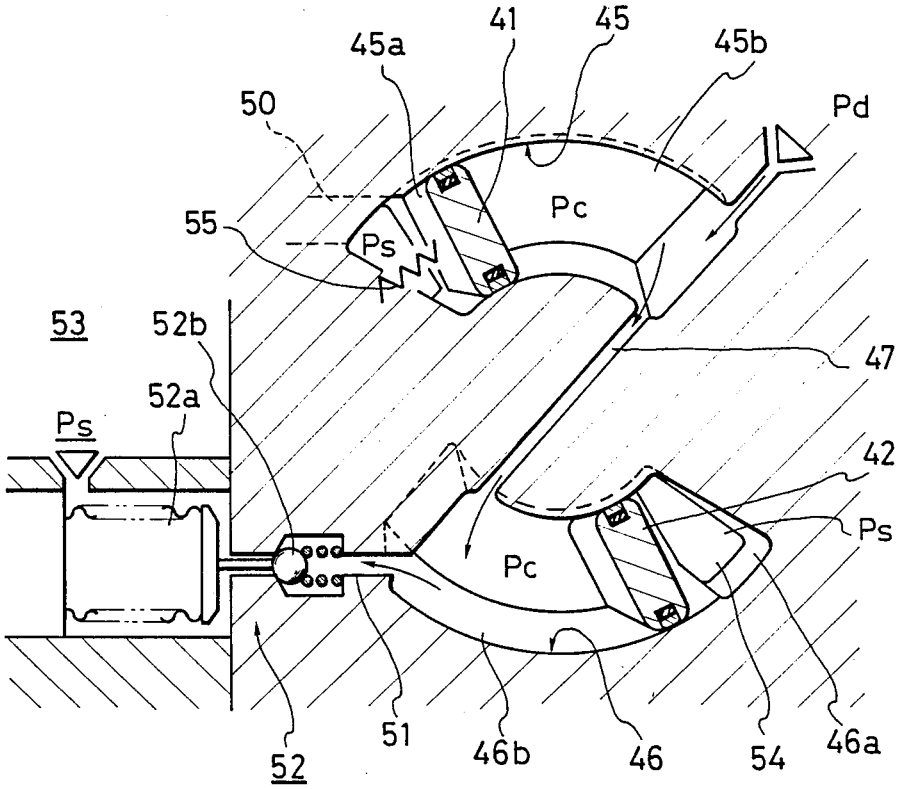
FIG. 7 is a view useful for explaining the operation of a capacity control device of the compressor of FIG. 3.

A suction chamber 53 shown in FIG. 7 is defined between the rear side block 23 and the rear head 25 and directly communicates with a suction port, not shown, formed in the rear head 25 and adapted to be connected to the refrigerating circuit.

As shown in FIGS. 3 and 4, refrigerant outlet ports 34 are formed through opposite lateral side walls of the cam ring 21 at predetermined circumferential locations. Each refrigerant outlet port 34 opens into a discharge valve chamber 35 formed in the cam ring 21. The discharge valve chamber 35 communicates, on one hand, with the front discharge pressure chamber section **31*a* through a communication hole 36 formed through the cam ring 21 and the front side block 22, and, on the other hand, communicates with the rear high pressure-introducing chamber section 33*a* through a communication passage 38 formed through the cam ring 21 and the rear side block 23**.

Figure 5:
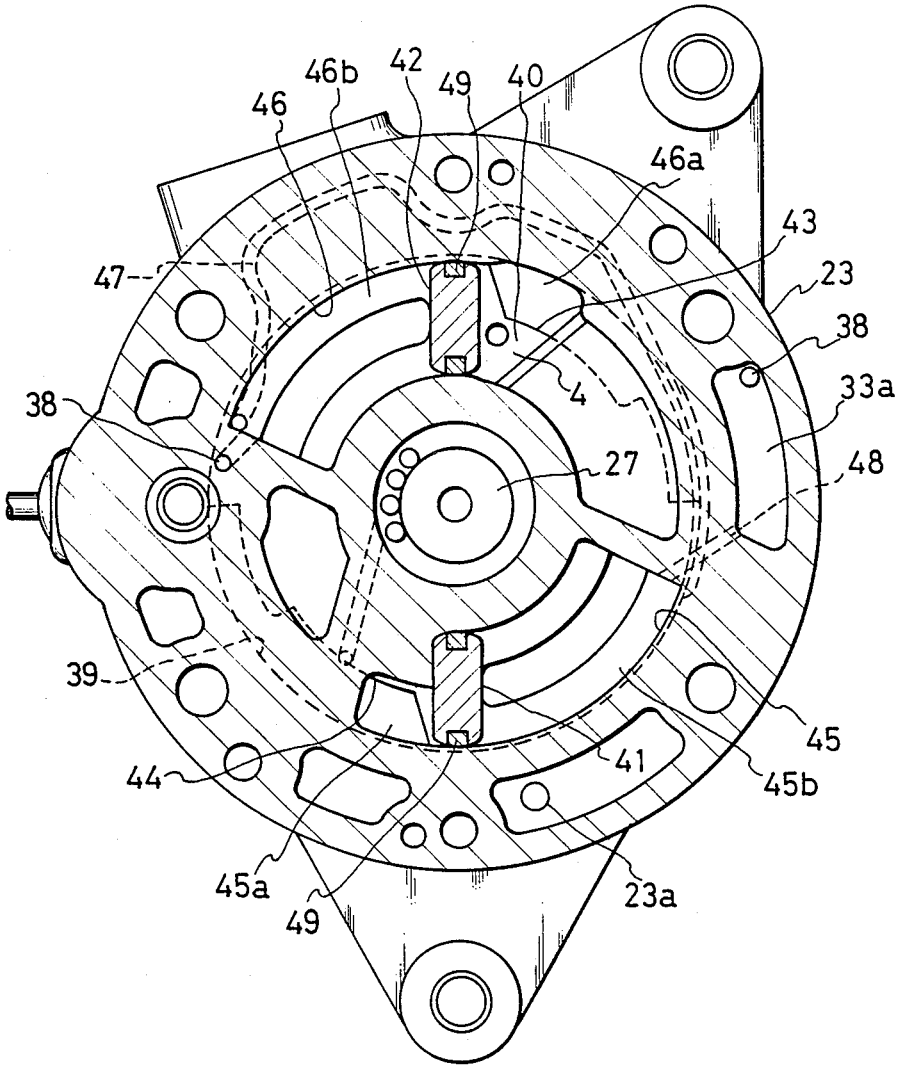
FIG. 5 is a transverse sectional view taken along line V—V in FIG. 3.

As shown in FIGS. 4 and 5, the rear side block 23 has an end face facing the rotor 26, in which is formed an annular chamber 39. A control element 40 in the form of an annulus is received within the annular chamber 39 for rotation about an axis thereof, i.e., about the axis of the drive shaft 27, in opposite circumferential directions. Thus, the annular chamber 39 and the control element 40 cooperate to form a capacity control device for controlling the capacity of the compressor. The control element 40 has its one side surface formed integrally with a pair of diametrically opposite pressure-receiving portion 41, 42, and its outer peripheral edge formed with a pair of diametrically opposite arcuate cut-out portions 43, 44, as shown in FIGS. 4 and 5. The pressure-receiving portions 41, 42 are slidably received in respective arcuate receiving recesses 45, 46 which are formed in a bottom of the annular chamber 39 at diametrically opposite locations in a manner circumferentially extending through a predetermined angle.

The interior space of each of the arcuate receiving recesses 45, 46 is divided into a low-pressure chamber **45*a*, 46*a* and a high-pressure chamber (control pressure chamber) 45*b*, 46*b* by the associated pressure-receiving portion 41. A sealing member 49, which may be formed of rubber and has a special configuration, is fitted in the control element 40 to seal between the low-pressure chamber 45*a*, 46*a* and the high-pressure chamber 45*b*, 46*b*, etc. in an airtight manner. These low-pressure chambers 45*a* and 46*a*** communicate with each other through a communication passage, not shown.

As shown in FIG. 7, one low-pressure chamber **45*a* communicates with the suction chamber 53 via a communication passage 70. The high-pressure chambers 45*b* and 46*b* communicate with each other by way of a communication passage 47 formed in the rear side block 23. One high-pressure chamber 46*b* communicates with the suction chamber 53 via a communication passage 51** and a control valve device 52. The high-pressure chambers 45b, 46b communicate with the high pressure-introducing chamber sections 33a of the rear discharge pressure chamber 33 through a communication passage 48 formed in the rear side block 23, as shown in FIG. 3.

A front oil supply pipe 71 is provided through the front side block 22 to supply oil within the front oil sump section 31b to the front bearing 28, etc. for lubricating them, whereas a rear oil supply pipe 22 is provided through the rear side block 23 to supply oil within the rear oil sump section 33b to the rear bearing 29, etc. for lubricating them, as shown in FIG. 3.

The above-mentioned control valve device 52 has a bellows 52a as a pressure-responsive member and is operable in response to pressure Ps prevailing within the suction chamber 53. That is, the control valve device 52 is closed when the suction pressure Ps is above a predetermined value, and opened when the suction pressure Ps is below the predetermined value.

The control element 40 is urged in the counter-clockwise direction as viewed in FIG. 5 (or clockwise direction as viewed in FIG. 4), i.e., in the direction of decreasing the capacity of the compressor, by a torsion coiled spring 55 shown in FIG. 7, which has one end engaged with the control element 40 and another end with the rear side block 23.

The operation of the compressor according to the invention constructed as above will now be explained.

As the rotor 26 rotates in the clockwise direction as viewed in FIG. 4, the vanes 30 revolve together with the rotating rotor 26, with their tips in sliding contact with the camming inner peripheral surface of the cam ring 21. During the suction stroke each compression chamber 50 defined by adjacent vanes 30 and 30 increases in volume so that refrigerant gas as thermal medium is drawn through refrigerant inlet ports 54 shown in FIG. 7 into the compression chamber 50; during the following compression stroke the compression chamber 50 decreases in volume to cause the drawn refrigerant gas to be compressed; and during the discharge stroke following the compression stroke the high pressure of the compressed gas forces the discharge valves 37 to open to allow the compressed refrigerant gas to be discharged through the refrigerant outlet ports 34 into the discharge valve chamber 35. Larger part of the compressed refrigerant gas thus supplied into the discharge valve chamber 35 is then discharged outside the compressor through the communication hole 36, the discharge pressure chamber section 31a, and the discharge port 32, in the mentioned order, whereas smaller part of the compressed refrigerant gas within the discharge valve chamber 35 is introduced into the high-pressure chamber 45b, 46b through the communication passage 38, the high pressure-introducing chamber section 33a, and the communication passage 48.

When the compressor is operated at a low rotational speed, the suction pressure Ps within the suction chamber is higher than the predetermined value so that the control valve device 52 is closed. Accordingly, the high pressure Pc within the high-pressure chambers 45b, 46b, supplied from the discharge valve chamber 35 through the communication passage 38, the pressure-introducing chamber section 33a, and the communication passage 48, is not allowed to leak into the suction chamber 53 due to the closure of the control valve device 52, so that it is maintained at a high level. As a result, the control element 40 is circumferentially displaced by the pressure Pc within the high pressure chamber 45b, 46b against the sum of the suction pressure Ps introduced into the low-pressure chamber 45a, 46a and the biasing force of the coiled spring 55, i.e., the control element 40 is displaced in the clockwise direction as viewed in FIG. 5 into a position shown in FIGS. 4 and 5. Consequently, the cut-out portion 43, 44 of the control element 40 is brought into a rearward position with respect to the rotation of the rotor 26 to advance the timing at which the refrigerant gas starts to be trapped within the compression chamber 50, and hence the timing of commencement of the compression stroke, thereby obtaining a large delivery quantity.

On the other hand, when the compressor is operated at a high rotational speed, the suction pressure Ps within the suction chamber is lower than the predetermined value so that the control valve device 52 is opened. Accordingly, the high pressure Pc within the high-pressure chamber 45b, 46b is allowed to leak into the suction chamber 53 through the open control valve device 52, so that the pressure Pc within the high-pressure chamber 45b, 46b is correspondingly lowered. As a result, the control element 40 is circumferentially displaced by the sum of the suction pressure Ps introduced into the low-pressure chamber 45a, 46a and the biasing force of the coiled spring against the pressure Pc within the high-pressure chamber 45b, 46b, i.e., the control element 40 is displaced in the counter-clockwise direction as viewed in FIG. 5. Consequently, the cut-out portion 43, 44 of the control element 40 is brought into a forward position with respect to the rotation of the rotor 26 to retard the timing at which the refrigerant gas starts to be trapped within the compression chamber 50, and hence the timing of commencement of the compression stroke, thereby obtaining a small delivery quantity.

The operation of controlling the capacity of the compressor described as above is similar to that of the conventional compressor, except for the manner of lubricating the compressor. That is, according to the invention, the oil collected within the respective discharge pressure chamber sections 31b and 33b is supplied to lubricating parts such as bearings 28, 29 for properly lubricating same, as follows:

Since in the rear discharge pressure chamber 33 the high pressure-introducing chamber sections 33a and the oil sump section 33b by the partition wall 33c are isolated from each other as mentioned before, the high pressure $P_{d1}$ within the discharge valve chamber 35 is introduced into the high-pressure chamber 45b, 46b of the capacity control device through the communication passage 38, the high pressure-introducing chamber section 33a, and the communication passage 48. On this occasion, no static pressure acts on the oil within the rear oil sump section 33b so that the oil surface level $L_1$ is maintained at a sufficiently high level, whereas the oil surface level $L_2$ within the front oil sump section 31b is correspondingly lowered. Therefore, oil within the rear oil sump section 33b can be supplied in sufficient quantities to the lubricating parts on the rear side through the rear oil supply passage 55.

Further, the high pressure-introducing chamber section 33a in the form of a substantially enclosed chamber which is much larger in cross-sectional area than the communication passages 38, 48 and hence serves as a muffler so that it prevents the high pressure as control pressure Pc supplied to the capacity control device from being subjected to pulsation in the discharge pressure.

Further, since the oil surface level $L_1$ within the rear oil sump section 33*b* is maintained so high that the oil surface level $L_2$ within the front oil sump section 31*b* is correspondingly low as stated above, the space above the oil surface level $L_2$ within the section 31*b*, i.e., the discharge pressure chamber section 31*a* substantially increases in volume, which leads to better separation of oil from the compressed refrigerant gas. Incidentally, the space above the oil surface level $L_1$ within the rear discharge pressure chamber 33 maintains the same volume after the gas pressure $P_{d2}$ prevailing above the oil surface level $L_2$ within the front discharge pressure chamber 31 becomes equal to the pressure $P_{d3}$ prevailing above the oil surface level $L_1$ within the rear discharge pressure chamber 33, i.e., $P_{d2}=P_{d3}$.

What is claimed is:

1. In a variable capacity compressor having a rotor, a cylinder accommodating said rotor, a plurality of compression chambers being defined in said cylinder between said rotor and said cylinder, said compression chambers varying in volume by rotation of said rotor, a first discharge pressure chamber provided on one side of said cylinder and having a discharge pressure chamber section located at an upper portion thereof to be supplied with compression medium as high pressure from associated one of said compression chambers, and an oil sump portion located at a lower portion thereof, a discharge port provided on said one side of said cylinder and directly communicating with said discharge pressure chamber section, a second discharge pressure chamber provided on the other side of said cylinder and having a high pressure-introducing section located at an upper portion thereof to be supplied with compression medium from associated one of said compression chambers, and an oil sump section located at a lower portion thereof, first communication passage means communicating said oil sump sections of said first and second discharge pressure chambers with each other, capacity control means operable in response to control pressure for controlling the capacity of said compressor, said capacity control means having a control pressure chamber in which said control pressure prevails, and second communication passage means communicating said high pressure-introducing section of said second discharge pressure chamber with said control pressure chamber, the improvement comprising means in said second discharge pressure chamber isolating said high pressure-introducing section from said oil sump section; and means for introducing said medium into said control pressure chamber from associated one of said compression chambers through said high pressure-introducing section and said second communication passage means while having no effect upon said oil sump section of said second discharge pressure chamber.

2. A variable capacity compressor as claimed in claim 1, wherein said high pressure-introducing section of said second discharge pressure chamber is in the form of a substantially enclosed chamber.

3. A variable capacity compressor as claimed in claim 2, including discharge valve means, a discharge valve member accommodating said discharge valve means, said third communication passage means communicating said discharge valve chamber with said high pressure-introducing section of said second discharge pressure chamber, and wherein said high pressure-introducing section has a substantially larger cross-sectional area than that of said third communication passage means.

4. A variable capacity compressor as claimed in claim 1, including first and second side blocks forming opposite ends of said cylinder, first and second heads secured to ends of respective ones of said first and second side blocks remote from said cylinder, and wherein said first discharge pressure chamber is defined between said first side block and said first head, and said second discharge pressure chamber is defined between said second side block and said second head.

5. A variable capacity compressor as claimed in claim 4, wherein said means isolating said high pressure-introducing section from said oil sump section of said second pressure chamber comprises partition wall means formed in said second head.

* * * * *